United States Patent [19]

Shaffer

[11] Patent Number: 4,694,819

[45] Date of Patent: Sep. 22, 1987

[54] LOCKING MEANS FOR FIREPLACE SCREEN

[76] Inventor: Donald L. Shaffer, R.R. 2, Box 399, Scottsburg, Ind. 47170

[21] Appl. No.: 900,682

[22] Filed: Aug. 27, 1986

[51] Int. Cl.[4] ..... F24C 15/10

[52] U.S. Cl. ..... 126/140; 160/126; 160/DIG. 9; 126/202; 126/139

[58] Field of Search ..... 126/140, 201, 202, 203, 126/121, 139; 160/DIG. 9, 330, 332, 126; 292/300

[56] References Cited

U.S. PATENT DOCUMENTS

| | | | |
|---|---|---|---|
| 1,234,873 | 7/1917 | Clampitt | 126/140 |
| 1,446,188 | 2/1923 | Lang | 126/202 |
| 1,779,660 | 10/1930 | Chadbourne | 160/DIG. 9 |
| 2,150,367 | 3/1939 | Eisele | 160/DIG. 9 |
| 4,068,699 | 1/1978 | Tucker | 126/140 |

FOREIGN PATENT DOCUMENTS

| | | | |
|---|---|---|---|
| 395988 | 7/1933 | United Kingdom | 126/202 |

*Primary Examiner*—James C. Yeung
*Attorney, Agent, or Firm*—Richard L. Caslin

[57] ABSTRACT

A fireplace screen fixture is shown for assembly to the front face of a fireplace opening. This fixture includes a metal frame capable of outlining a fireplace opening, and it has a supporting rod extending transversely across the upper portion of the frame from one side to the other. A plurality of ring members are threaded onto the supporting rod and they are capable of moving along the length of the rod. A pair of wire screen curtains are supported within the frame by being suspended at their upper portions from the ring members. The invention comprises a sheet metal locking strip attached to the vertical mating side edge of each screen curtain so that when these two screen curtains are stretched closed these two locking strips are interlocked with each other as a safety measure to keep logs or wood from falling accidentally through the screen while the fire is burning. Also, the screen curtains are prevented from developing a gap and allowing sparks to enter the room as a fire hazard.

6 Claims, 8 Drawing Figures

LOCKING MEANS FOR FIREPLACE SCREEN

BACKGROUND OF THE INVENTION

1. Field of the Invention:

This invention relates to the art of fireplace screens for use in the home and, particularly, to safety screens that are locked together at the center when closed to prevent logs or wood from falling accidently through the screen separation.

2. Description of the Prior Art:

A thorough search of the prior art was made, and it turned up the Eisels U.S. Pat. No. 2,150,367 disclosing a fireplace screen provided with supporting rings and movable by means of a chain and pulley system. Each screen has a slidable plate element used for overlapping the vertical mating surfaces of the screens.

The Helwig U.S. Pat. No. 2,627,914 shows a fireplace front where the two screens are each mounted on a tubular frame, and each forms a gate-like section that pivots about vertical hinges at the opposite sides of the fireplace opening. A small conventional catch holds these two gate-like sections closed.

The Eckles U.S. Pat. No. 2,616,499 describes a fireplace screen having two curtain-type screens which are supported from a horizontal shaft. This shaft has both left- and right-hand worms which are used to propel the screens open and closed in a manner of a screw action. The mating vertical edges of the two screens comprise vertical curtain rods extending downwardly, and they are capable of overlapping when the screens are in their fully-extended position.

The Donnelly U.S. Pat. No. 1,344,756 shows a window screen rather than a fireplace screen. The purpose of this window screen is to allow fresh air to enter the room while preventing insects from passing between the screens. These screens are rolled on rollers at the vertical sides of the window. When the two screens are closed, there is an overlapping relationship between the mating vertical edges rather than an interlocking action.

The Cox U.S. Pat. No. 652,509 describes a sheet metal mantel serving as the finish around a fireplace. This mantel includes sheet metal doors which can slide back and forth. When they are in their fully-extended position they entirely close the fireplace opening so as to extinguish the fire in a fireplace by shutting off the draft of air from the room up the chimney. They also prevent fire from sparks flying into the room when no occupant is present in the room and on the alert to extinguish them. There is no screen involved in this mantel design of Cox. When a wide fireplace opening is furnished with these sheet metal panels, each panel is replaced by a pair of sections having opposite vertical edges to interlock. These interlocking edges also serve to prevent buckling and warping of the sheet metal panels.

The Jackson U.S. Pat. No. 1,926,443 describes a standard fireplace screen where the two screen sections overlap when they are extended. At the lower of the screen there is a small hook for joining these overlapping edges together at the bottom of the two screens.

The last patent is to Mears U.S. Pat. No. 3,136,356, which is not in the fireplace screen art at all. This patent describes a rubber-coated cloth or a sheet plastic for use in forming a flexible door that is an impermeable slit-type. In one position it closes the doorway, and in the other position it allows a person to force his way through the slit. This type of impermeable slit-type flexible door is apparently useful by the Federal government as a passage into and out of protective shelters with a minimum infiltration of contaminants, as for use in CLEAN ROOMS that are used in the manufacture of high technology electronic devices. This design is not operating at high temperatures, and it requires the use of rubber or plastic tubing which, of course, would not withstand high temperatures.

OBJECTS OF THE PRESENT INVENTION

The principle object of the present invention is to provide a fireplace screen fixture having a pair of movable screen curtains with sheet metal locking strips attached to the vertical mating side edge of each screen curtain so that when the curtains are stretched closed the two locking strips are bound together from one end to the other.

A further object of the present invention is to provide movable screen curtains of the class described with interlocking sheet metal safety strips to form a rather rigid construction which is able to withstand the high temperature and prevent the warpage of the curtains that might otherwise form openings between the mating edges of the screen curtains.

SUMMARY OF THE INVENTION

The present invention provides a fireplace screen fixture that is to be mounted in a fireplace opening. The fixture comprises a frame that is capable of outlining the fireplace opening, and it has an elongated supporting rod suspended transversely across the upper portion of the frame. This rod supports a pluralty of ring members that are threaded onto the rod and capable of sliding along the length thereof. A pair of wire screen curtains are suspended at their upper portions from the plurality of ring members. These two screen curtains are movable away from each other to a folded-away open position for use in loading the fireplace with wood or in cleaning the fireplace. When the wood is lighted the two screen curtains are then moved towards each other to a stretched closed position. A sheet metal locking strip is attached to the vertical mating side edge of each screen curtain so that when the two screen curtains are stretched closed these two locking strips are interlocked with each other to form a bond that will prevent logs or wood from falling through the screen curtains as well as prevent sparks from escaping and landing on the rug or floor to cause a fire hazard.

BRIEF DESCRIPTION OF THE DRAWINGS

This invention will be better understood from the following description taken in conjunction with the accompanying drawings, and its scope will be pointed out in the appended Claims.

DESCRIPTION OF THE PREFERRED EMBODIMENTS

Figure 1:
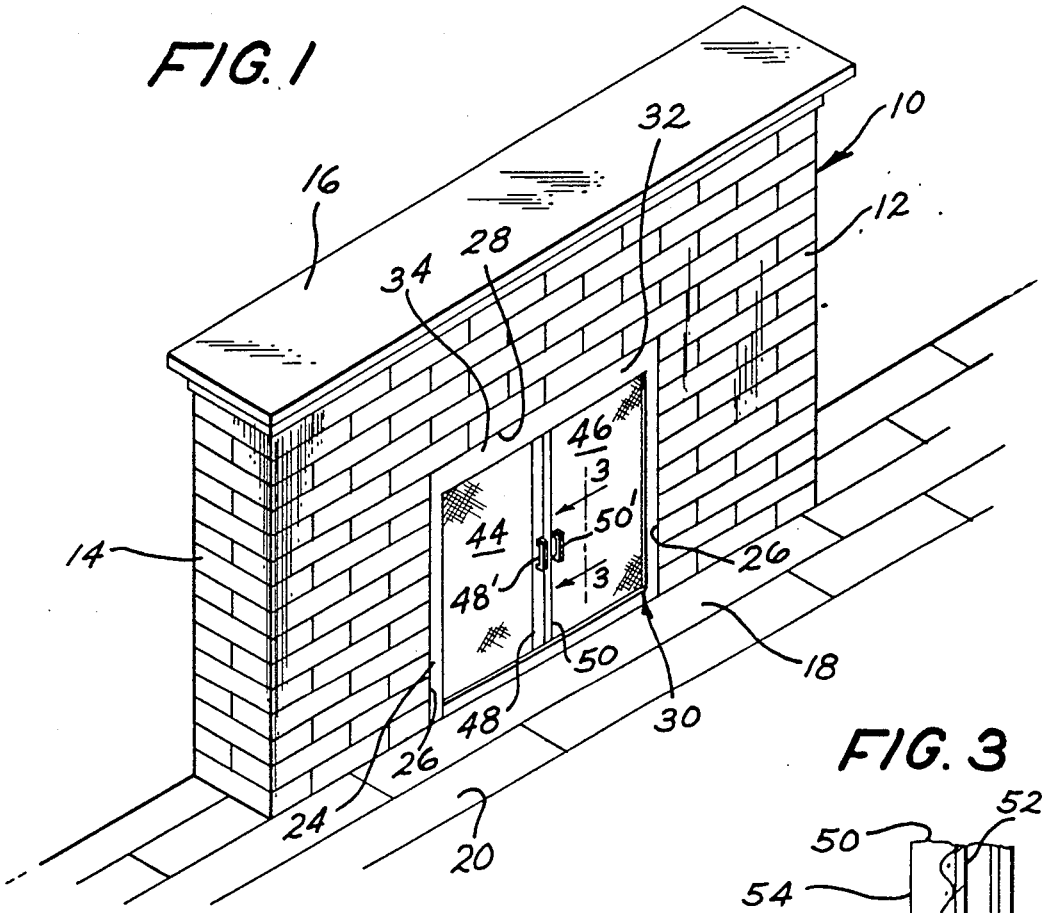
FIG. 1 is a front perspective view of a fireplace having installed in the fireplace opening a fireplace screen fixture embodying the screen curtains of the present invention which are interlocked together when they are stretched closed.

Turning now to a consideration of the drawings and, in particular, to the front perspective view of FIG. 1, there is shown a fireplace 10 having a front wall 12, opposite sidewalls 14, and a mantel 16 at the top. A hearth 18 of stone or brick is arranged at the floor level and extends across the front of the fireplace to separate the wood floor 20 from the heat within the fireplace.

The fireplace has a front opening 24 that is defined by opposite sidewalls 26 and a top wall 28. A fireplace screen-fixture 30 is mounted within this front opening 24, generally flush with the front wall 12 of the fireplace. It is understood that some fireplace screen fixtures are also provided with glass doors, but they are not included in this description because they form no part of the present invention.

Figure 2:
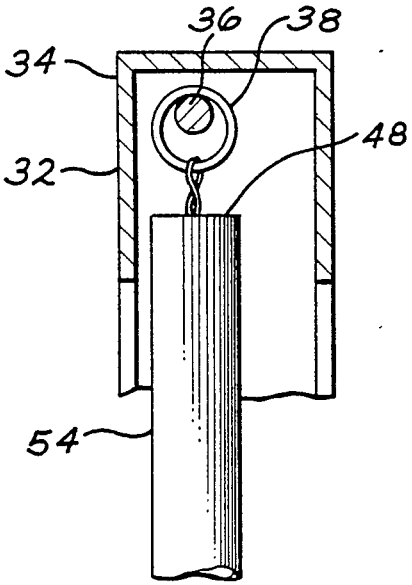
FIG. 2 is a fragmentary, transverse, cross-sectional, elevational view showing a top portion of the metal frame that supports the two fireplace screen curtains hung from a supporting ring threaded on an elongated rod at the top of the screens, looking into the end of the left-hand screen curtain along the plane thereof.

The fireplace screen fixture 30 includes a four-sided metal frame 32, which is capable of outlining the fireplace opening 24. These four sides of this metal frame 32 may be of different configurations. This metal frame 32 has a top wall, or span, 34 that is in the shape of an inverted channel member, as is best seen in the fragmentary, cross-sectional, elevational view of FIG. 2. Assembled within this inverted channel is an elongated support rod 36 which extends for nearly the entire width of the top wall, or span, 34 and is supported from its opposite ends within the sidewalls of the frame. As is conventional in this art, a pluralty of ring members 38 are threaded onto this supporting rod, and they are capable of sliding along the length thereof.

A pair of wire screen curtains 44 and 46 are joined to the plurality of ring members along the upper edge of each screen curtain so that the curtains are suspended from the ring members in a generally vertical plane when the two screen curtains are stretched together into the closed position, as shown in FIG. 1. As is conventional in this art, the opposite side edges of each screen curtain 44 and 46 that is adjacent the opposite sidewalls 26 of the front opening 24 are held fixed, and they do not move. All movement of these two screen curtains 44 and 46 is either toward or away from the fully closed position, as shown in FIG. 1. Admittedly, such wire screen curtains 44 and 46 are frequently provided with draw chains (not shown), which operate in the manner of drawstrings of draw drapes, for ease in opening and closing these complementary screen curtains 44 and 46.

The present invention was discovered while attempting to eliminate accidents around fireplaces which have occurred in the past when logs or wood might shift in the fireplace and fall against the screen curtains and pass through the vertical opening forced between the screens and allow burning embers and sparks to pass into the room where the wood floor or carpets might become ignited and create a serious fire hazard. Another difficulty in the prior art is that many wire screen curtains become warped, or bent, along the vertical edges at the center of the fireplace opening after being subjected to the high temperature created within the fireplace such that dangerous openings are created between the mating edges of the screen curtains to allow sparks to pass into the room.

Figure 3:
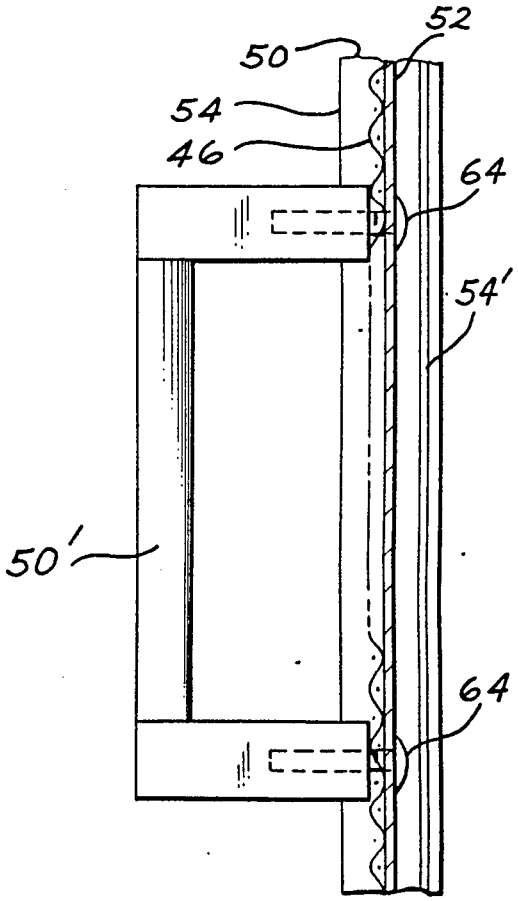
FIG. 3 is also a fragmentary, cross-sectional, elevational view, taken on the Line 3—3 of FIG. 1, showing the handle mounted midway of the vertical edge of the right-hand screen curtain.
Figure 4:
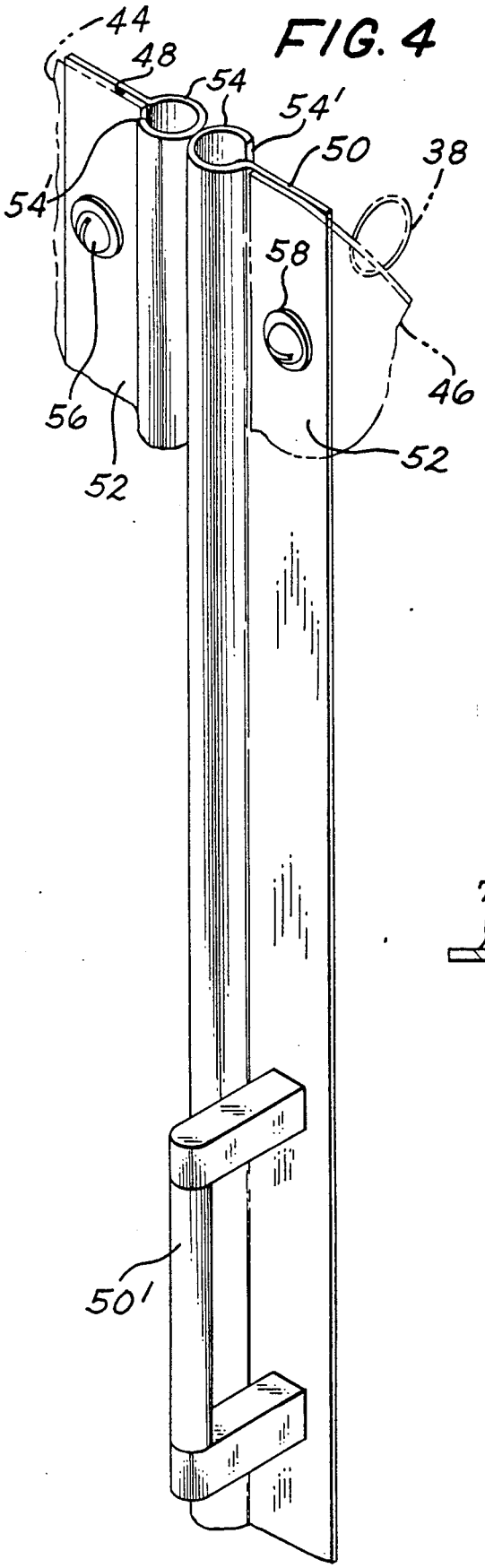
FIG. 4 is a fragmentary front perspective view showing a pair of similar sheet metal locking strips at the mating vertical edges of the two fireplace screen curtains in a nearly-closed position.

Turning now to a consideration of FIG. 4, this is a fragmentary front perspective view showing a pair of sheet metal locking strips 48 and 50, each arranged vertically to a side edge of one of the wire screen curtains. Locking strip 48 is attached to the left-hand wire screen curtain 44, while the locking strip 50 is joined to the right-hand wire screen curtain 46. These two locking strips 48 and 50 are identical parts, but one is reversed relative to the other. Each locking strip has a planar section 52 for attachment to the vertical mating side edge of the adjacent screen curtain, and a rolled, circular open hook portion 54. Notice that the planar section 52 is placed against the back surface of the edge of the adjacent screen 44 or 46, as is seen in both FIGS. 4 and 5. A plurality of screw fasteners 56 are used for attaching the screen curtain to the sheet metal locking strip. Each screw fastener 56 is provided with a large washer 58, under its head, to bear against the screen curtain and prevent the curtain from tearing. Each screw fastener is held in place by a lock nut 60. Notice, at about the mid-height of each locking strip 48 and 50, there is a vertical handle 48' and 50' respectively. These two handles are used, generally at the same time, for opening and closing the two wire screen curtains 44 and 46 in unison. Notice, in FIG. 3, that each handle is held in place on the sheet metal locking strip by means of screw fasteners 64 that are assembled from the back side of the adjacent screen curtain and are threaded into horizontal portions of each handle, as shown in dotted lines.

Figure 5:
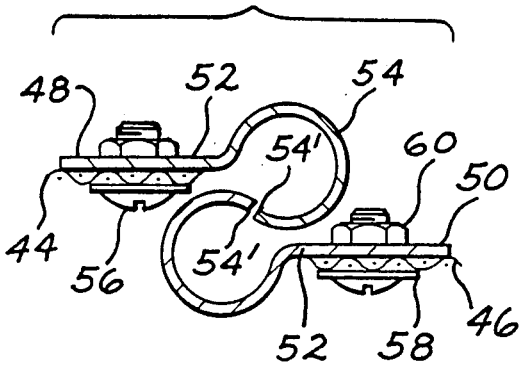
FIG. 5 is a fragmentary, transverse, cross-sectional plan view taken through the two overlapping sheet metal strips of FIG. 4 just before these strips are interlocked together.
Figure 6:
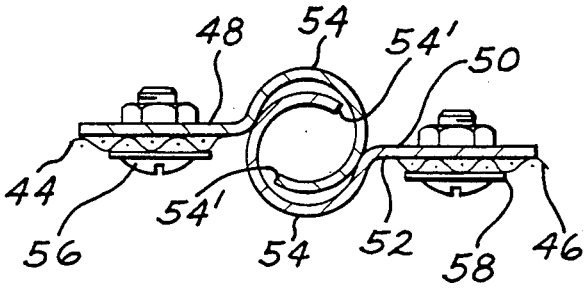
FIG. 6 is a fragmentary, transverse, cross-sectional plan view, similar to that of FIG. 5, when the two overlapping strips are in their final interlocked position to form a bond to prevent these two screen curtains from being opened inadvertantly.

Comparing FIGS. 5 and 6, the method of interlocking these two sheet metal locking strips 48 and 50 is illustrated. FIG. 5 is an intermediate position showing the open hook portion 54 of each locking strip 48 and 50 as overlapping each other. This overlapping is caused by drawing the two screen curtains 44 and 46 together from the first touching position of FIG. 4 to an overlapping position of FIG. 5. Moving from FIG. 4 to the position of FIG. 5, the two locking strips wedge the other locking strip to the side since they are generally in the same vertical plane in FIG. 4. When the open hook portions 54 overlap each other, the locking strip 48 moves rearwardly slightly, while the locking strip 50 moves forwardly. Each open hook portion 54 has a vertical edge 54' which becomes self-locking as they pass each other, as shown in FIG. 5, so that the weight of the screen curtains tend to force each open hook portion 54 within the other to the fully-locked position of FIG. 6.

The material of each locking strip 48 and 50 may be of the same material as the frame 32 of the fireplace screen fixture. Of course, other types of handles could be used, such as a knob, without departing from the scope of the present invention. Also, other types of locking strips could be used in order to accomplish similar, or related, results.

Figure 7:
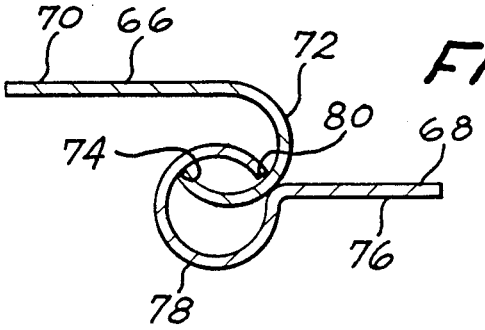
FIG. 7 is a fragmentary, transverse, cross-sectional view of a second modification of the present invention in their final interlocked position, showing the two interlocking sheet metal strips as being dissimilar elements where one strip member has a rolled, circular, wide-open hook portion while the other strip has a rolled, circular, nearly-closed hook portion.

FIG. 7 is a second modification of the present invention showing substitutes for the sheet metal locking strips 48 and 50, where one sheet metal locking strip 66 is dissimilar from the other sheet metal locking strip 68. The locking strip has a planar section 70 for attachment to the adjacent wire screen curtain, as heretofore, and it has a rolled, circular, wide-open hook portion 72, where the hook portion has a vertical edge 74. The other locking strip 68 has a planar section 76; again, for attachment to the adjacent vertical edge of a screen curtain, and a rolled, circular, nearly-closed hook portion 78 that has a vertical edge 80. Thus, these two sheet metal locking strips 66 and 68 are interlocked when the vertical edges 74 of the locking strip 66 is inserted into the nearly-closed hook portion 78 of the other locking strip 68. Then, the two screen curtains 44 and 46 are moved in opposite directions to further the penetration of each hook portion within the other until reaching the fully-locked position of FIG. 7.

Figure 8:
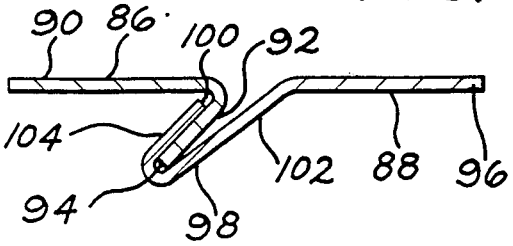
FIG. 8 is a transverse, cross-sectional, plan view of the two interlocking sheet metal strips showing a third modification of the present invention in their final interlocked position, where the locking strips are dissimilar. One strip has an angular hook portion formed at a reentrant angle, while the other strip has a forward, angular, doubled-over hook portion which is adapted to engage over the reentrant angular hook portion of the first strip.

FIG. 8 is a third modification of the present invention, and it, again, shows two dissimilar sheet metal locking strips 86 and 88. Locking strip 86 has a planar section 90 for attachment to the adjacent screen curtain, and an angular hook portion 92 that is formed at a reentrant angle, and it has a vertical edge 94. The other locking strip 88 also has a planar section 96 for attachment to the adjacent screen curtain and a forward, angular, doubled-over hook portion 98, which is adapted to engage over the reentrant angular hook portion 92 of the mating locking strip 86. This double-over hook portion 98 has a vertical edge 100, which is adapted to slip over the vertical edge 94 of the opposite locking strip. The reentrant angle of the angular hook portion 92 is an acute angle, shown at about a 45 degree angle, while the hook portion 98 has a forward angle that is an obtuse angle, as is clear from FIG. 8. This forward angular portion is given numeral 102, and its tip is doubled-over at 104. This is all illustrated in the third modification of FIG. 8.

Modifications of this invention will occur to those skilled in this art. Therefore, it is to be understood that this invention is not limited to the particular embodiments disclosed but that it is intended to cover all modifications which are within the true spirit and scope of this invention as claimed.

What is claimed is:

1. A fireplace screen fixture for assembly to the front face of a fireplace opening, said fixture comprising:

a. a frame capable of outlining a fireplace opening, and having a supporting rod suspended transversely across the upper portion of the frame from one side to the other, and a plurality of ring members threaded onto the supporting rod and capable of sliding along the length thereof; and b. a pair of wire screen curtains suspended at their upper portions from the said ring members, and movable away from each other to a folded-away open position, as well as being movable toward each other to a stretched closed position capable of stretching across the fireplace opening;

c. the invention comprising a sheet metal locking strip attached to the vertical mating side edge of each screen curtain, so that when the two screen curtains are overlapped and stretched closed these two locking strips are interlocked with each other to form a bond that will prevent these two screen curtains from being opened inadvertently until these two interlocking strips are purposely disengaged from each other by human intervention.

2. The fireplace screen fixture invention as recited in claim 1 wherein the said vertical pair of sheet metal overlapped and interlocking strips extend into the frame at both the top end and bottom end of the strips so the strips are confined by as well as being reinforced by the frame, and each vertical interlocking strip is provided with a handle on the outer surface thereof and adjacent the midheight for ease in interlocking the mating strips as well as disengaging the interlocking strips.

3. The fireplace screen fixture invention comprising a pair of overlapping and interlocked metal strips as recited in claim 1 wherein each sheet metal locking strip has a transverse cross section with a planar section for attachment to the vertical mating side edge of one of the screen curtains and a rolled circular open hook portion, where the two locking strips are reversed one to the other so that the open hook portions are facing each other for ease in interlocking these two locking strips in a closed safety position.

4. The fireplace screen fixture invention as recited in claim 1 wherein each sheet metal locking strip is substantially identical to the other one, but are reversed one tot he other with open hook portions that are facing each other for ease in interlocking these two locking strips in a closed safety position.

5. The fireplace screen fixture invention comprising a pair of overlapping interlocked metal strips as recited in claim 1 wherein each sheet metal locking strip is dissimilar to the other strip, where one strip has a transverse cross section with a planar section for attachment to the vertical mating side edge of one of the screen edge of one of the screencurtains, and a rolled circular wide-open hook portion, and the other strip has a transverse cross section with a planar section for attachment to the edge of the other screen curtain, as well as a rolled circular nearly-closed hook portion, where the strip with the wide-open hook portion is to be guided into engagement with the gap in the nearly-closed hook portion.

6. The fireplace screen fixture invention comprising a pair of overlapping interlocked metal strips as recited in claim 1 wherein each sheet metal locking strip is dissimilar to the other strip, where one strip has a transverse cross section with a planar section for attachment to one vertical side edge of one of the screen curtains, and an angular hook portion formed at a reentrant angle, and the other strip has a transverse cross section with a planar section for attachment to one vertical side edge of the other screen curtain and a forward angular doubled-over hook portion which is adapted to engage over the reentrant angular hook portion of the other strip.

* * * * *